US006374415B1

(12) United States Patent
Lenart

(10) Patent No.: US 6,374,415 B1
(45) Date of Patent: Apr. 23, 2002

(54) SEPARABLE PERSONAL CARE GARMENT THAT PROTECTS DIGNITY

(76) Inventor: Robin Lenart, 5815 S. Federal Hwy. #11, Stuart, FL (US) 34997

( * ) Notice: Subject to any disclaimer, the term of this patent is extended or adjusted under 35 U.S.C. 154(b) by 0 days.

(21) Appl. No.: 09/675,631

(22) Filed: Sep. 29, 2000

Related U.S. Application Data

(60) Provisional application No. 60/179,580, filed on Feb. 1, 2000, and provisional application No. 60/159,118, filed on Oct. 13, 1999.

(51) Int. Cl.[7] ..... A41D 13/00

(52) U.S. Cl. ..... 2/114; 2/69

(58) Field of Search ..... 2/114, 69, 104, 2/105, 106, 80, 83, 220, 221, 49.1, 51, 46

(56) References Cited

U.S. PATENT DOCUMENTS

| | | | | | |
|---|---|---|---|---|---|
| 2,436,610 | A | * | 2/1948 | Saxon | 2/80 |
| 2,635,245 | A | * | 4/1953 | Nigro | 2/80 |
| 2,808,590 | A | * | 10/1957 | Siegel et al. | 2/80 |
| 4,754,500 | A | * | 7/1988 | Brucato et al. | 2/105 |
| 4,759,083 | A | * | 7/1988 | Belcher | 2/114 |
| 4,837,863 | A | * | 6/1989 | Van Scoy-Mosher | 2/114 |
| 5,327,586 | A | * | 7/1994 | Evans et al. | 2/211 |
| 5,361,414 | A | * | 11/1994 | Smith | 2/114 |
| 5,454,119 | A | * | 10/1995 | Thomm | 2/114 |
| 5,575,006 | A | * | 11/1996 | Wolfe | 5/114 |
| 5,640,715 | A | * | 6/1997 | Adams | 2/46 |

* cited by examiner

*Primary Examiner*—Gloria M. Hale

(57) ABSTRACT

A separable reusable or disposable personal care garment comprising a lower torso skirt having one or more panels and a upper torso bib panel which releasably attaches to the skirt at the waistline and covers private body areas giving dignity to the wearer. The skirt encircles the lower torso and is secured with releasable fasteners forming an overlap of skirt ends. The three-panel embodiment comprises a rectangular shaped center panel overlapping two rectangular panels on either side. An expandable mechanism is added such as elastic along the waistline for a comfortable fit. The upper torso bib panel has two shoulder extensions which attach to each other forming a tear-dropped shaped neck opening and overlaps the skirt at the waistline. The bib can be released for access to the breast area or for removal. All overlaps and panels allow entry for personal care out of view of others.

21 Claims, 8 Drawing Sheets

SEPARABLE PERSONAL CARE GARMENT THAT PROTECTS DIGNITY

This application claims the benefit of provisional applications 60/179,584, filed Feb. 1, 2000 and Ser. No. 60/159,118, filed Oct. 18, 2000.

BACKGROUND

1. Field of the Invention

This invention relates to a personal care garment for use by persons desiring personal privacy. In particular, this invention relates to a separable garment having panel(s) covering the private body areas of the wearer preserving the wearer's dignity and modesty.

2. Description of Prior Art

As our population ages, the need for assisted living facilities and home health care grow. The baby boomers are becoming the "sandwich generation" balancing their children's needs, as well as their aging parents. Because of high costs, many families are caring for loved ones at home. Many become the primary caregiver with the more fortunate hiring help for the ADL's (Activities of Daily Living). As ADL's include personal care (bathing, clothing changes, and toilet duties), receiving assistance with ADL's can be spelled out "Another Dignity Lost". For those too frail to stand in the shower or undress themselves, aides or family caregivers are called to assist, introducing an awkward and troubling problem with maintaining personal privacy for the one receiving help.

In the medical community it is common practice for a doctor or medical personal to supply a type of gown to protect a patient's modesty while performing various medical procedures and examinations. Sadly, in the home or non-medical settings where simple personal care is needed, there has not been one garment available that protects the dignity of the person being helped with personal care. Although a number of medical garments are presently available, they are inappropriate or useless for protecting personal privacy in personal care. As a result, elderly and disabled men and women suffer shame and embarrassment as they endure being viewed naked by their aides or worse by their adult children. For family members, the confusion and humiliation can be magnified for both care-receiver and caregiver. Tragically, many frail and disabled loved ones refuse the personal care they so desperately need because the fear of dignity loss.

As tradition and mentality of the home health industry communicates a silent message of "it's always done this way" a sense of futility can result. Ultimately, the ones we desire to respect and honor the most are gradually stripped of their dignity without hope.

Thankfully this Personal Care Garment finally solves the embarrassing problem of exposure in the shower, during clothing changes, while on the commode, or when in the presence of another.

Prior to this Personal Care Garment, the only choice was to bear the shame of exposure, because no personal care garments were invented yet, and the poor design of other garments left no choice as they were made for quite a different purpose. For example, U.S. Pat. No. 5,575,006, Wolfe discloses a lower torso only hospital garment for medical treatment purposes which is unsuitable for personal care in the shower as the whole body is normally exposed. If the care recipient happens to be a female, the breast area of the wearer would be exposed in this prior art.

Still another deficit to this hospital garment is it fails to offer the back opening needed for personal care in a shower chair. Likewise, the design made for tube or wire entry in medical procedures is inappropriate and awkward for personal care during toilet duties.

Another example of prior art that is ill suited for personal care is U.S. Pat. No. 4,759,083, Belcher, which is designed for medical procedures. The upper torso bib disclosed would render the female wearer exposed during personal care when the bra is removed, during bathing, and when dressing into dry clothes. The wearer also would view themselves exposed as the flap falls down and hangs from the waist during bathing. Not only is this prior art garment useless for the female, it is not usable for a male during personal care either. A man for instance, could not bathe or clean his back without the entire gown falling down to expose his private body areas, or when lifting the gown up likewise exposing himself. Dressing, bathing, or using a commode has unique needs for both care recipient and in some cases a caregiver which hospital type gowns fail to fulfill.

Other hospital garments have the same problem in their one-piece gown structure, such as U.S. Pat. No. 5,361,414, Smith and U.S. Pat. No. 4,837,863, Van Scoy-Mosher, designed for medical settings. This poor design causes exposure of the lower torso when personal care is given to the upper torso. Also, the gown sleeves or arm openings prevent removal or replacing of the bras, causing embarrassing exposure.

Teens and children too, care about privacy during personal care. Because a personal care garment was not invented yet, many students dropped out of team sports because of the embarrassment of shared showers. Many preteens likewise gave up summer camps because of the dread of being exposed to others during shower time.

None of these patents teach or render obvious singly or when considered in combination, applicant's invention.

SUMMARY

This present invention is directed to a separable personal care garment that preserves the wearer's sense of modesty. A personal care garment has multiple uses. In a particularly preferred use, the Personal Care Garment allows access for personal intimate hygiene, while maintaining a sense of dignity for the wearer.

In particular, the personal care garment is directed to a garment designed specifically to protect dignity and personal privacy of a person comprising:

a) A panel or panels that wrap and attach around the lower torso of the wearer modestly covering the buttocks, pelvic and upper thigh area.

b) a detachable bib that covers the breasts of a female wearer.

c) a means of attaching the bib to the lower torso garment or removing the bib, allowing coverage adapted to the wearer.

OBJECTS AND ADVANTAGES

It is the principle object of this invention to remedy the humiliating problem as related in the above Background—Description of Prior Art.

More specifically, it is an object of the invention to provide a means of protecting dignity and personal privacy for a person during personal care.

Another object is to provide a family friendly barrier to the intimate boundaries between parents and their adult children, protecting the integrity of the relationship during personal care.

A further object is to provide personal privacy for anyone where others traditionally would be present. Public showers, locker rooms and open changing areas would no longer be embarrassing with the benefit of this invention.

Another object is to provide therapists and their clients a comfortable garment during personal care training and rehabilitation without distraction or humiliation, which would diminish the effectiveness of the consultation. The Personal Care Garment will allow for a respectful atmosphere between the therapist and the client encouraging progress and participation.

Another object is to provide a means for dignified clothing changes of the wearer. Undergarments can be removed in preparation for bathing while staying covered. A Personal Care Garment wet from the shower or bath can be covered with another dry Personal Care Garment allowing for a modest removal of the wet garment. Dressing into dry clothes can be achieved while covered under the Personal Care Garment.

A further object is to provide a garment that shields from view private body areas during toilet duties, reducing exposure and embarrassment when assistance is needed. The process of pulling undergarments down, sitting on the toilet, and pulling undergarments up can be done discreetly under the cover of the Personal Care Garment.

Another object of this invention is to provide a garment for the long-term care residents offering them protection of their rights to privacy and the consideration of their dignity by legal statutes.

Another object is to provide superior coverage for both males and females during exams or medical procedures.

Respect and honor for those who deserve it most can now be achieved. The use and availability of this practical and novel garment can eliminate the dread of losing dignity in care facilities.

It is therefore, the object of applicant's present invention to provide a simple, easy to manufacture, attractive garment that allows access for personal care while the wearer remains covered, that protects dignity.

Still further objects and advantages will become apparent from a consideration of the ensuing description and drawings.

BRIEF DESCRIPTION OF THE DRAWING FIGURES

In the drawings, closely related figures have the same number but different alphabetic suffixes.

REFERENCE NUMERALS IN DRAWINGS

Figure 4:
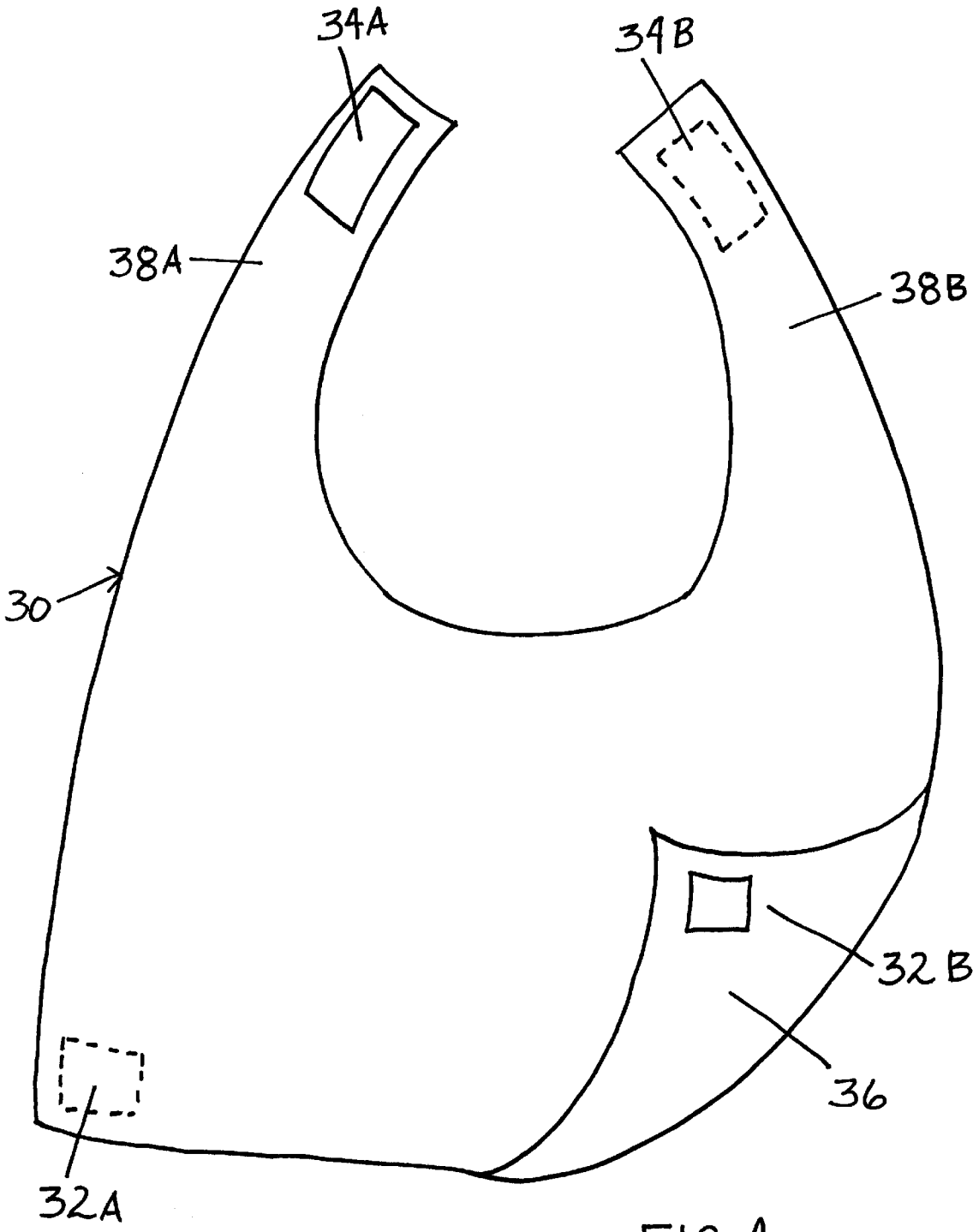
FIG. 4 is a flat view of the detachable bib.

10 triple panel garment
12 center panel
14A side panel
14B side panel
16A overlap of side and center panel
16B overlap of side and center panel
18A fastener
18B fastener
20 overlap
22A fastener to attach bib to triple panel garment
22B fastener to attach bib to triple panel garment
30 detachable bib
32A fastener on bib to attach to lower garment
32B fastener on bib to attach to lower garment
34A fastener
34B fastener
36 inside or lining of FIG. 4
38A shoulder extension
38B shoulder extension
40 single panel garment
42A fastener to connect bib to skirt
42B fastener to connect bib to skirt
44 inside or lining
46A fastener
46B fastener
48 gathered waist
50 overlap
60 shoulder extensions in a overlapped fastened position.

DESCRIPTION

FIGS. 1–4 Preferred Embodiment

Figure 1:
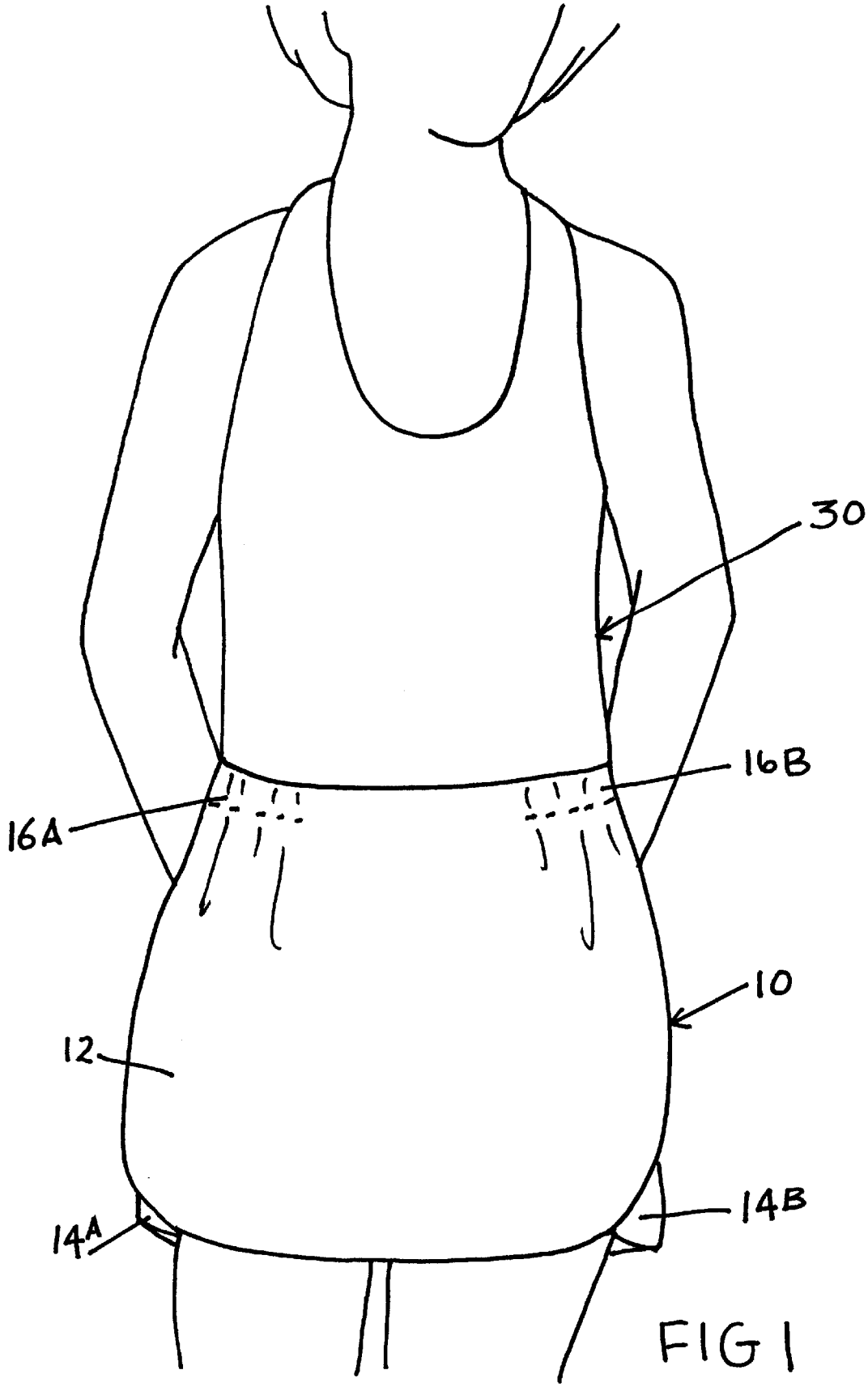
FIG. 1 is a perspective view of a female person wearing the invention.

Referring now to the drawings, as illustrated in FIG. 1 the garment of the present invention is shown, as it would appear on a female person. The garment may be made of any conventional woven or non-woven fabric. Preferably, a water-repellent nylon or synthetic mesh for example would allow for appropriate wet use for bathing. For dry use, an absorbent terry cloth, jersey knit or similar fabric would be preferred. Materials such as paper, plastic or non-woven could be used for disposable wet or dry use. The lower torso garments 10 and 40 and a detachable bib 30 can be manufactured as a wash and wear reusable garment as well as a limited use disposable garment. An identical soft lining may be stitched or glued to each garment 10, 40 and/or bib 30 for comfort and attractiveness.

Figure 2A:
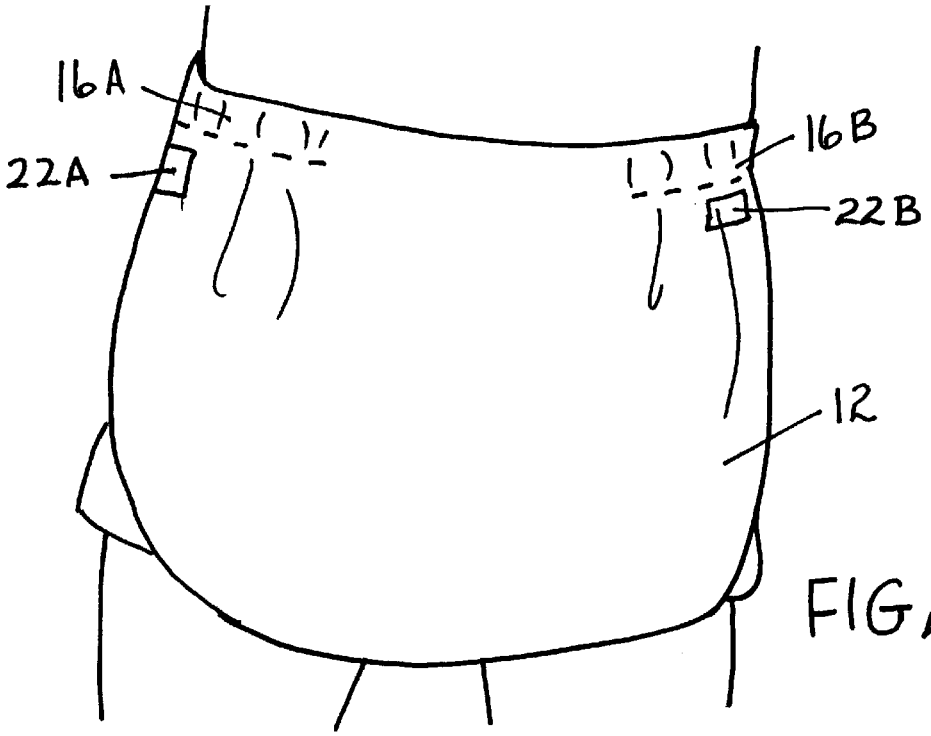
FIGS. 2A and 2B are a perspective view of a male person wearing the invention, front and back respectively.
Figure 2B:
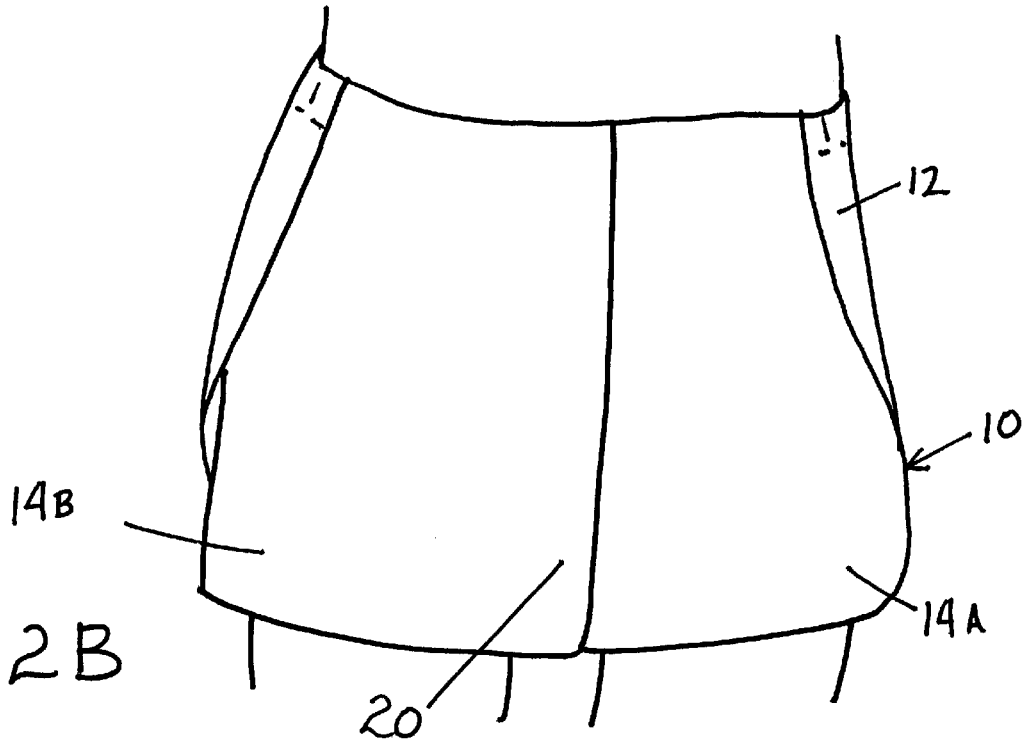
Figure 3A:
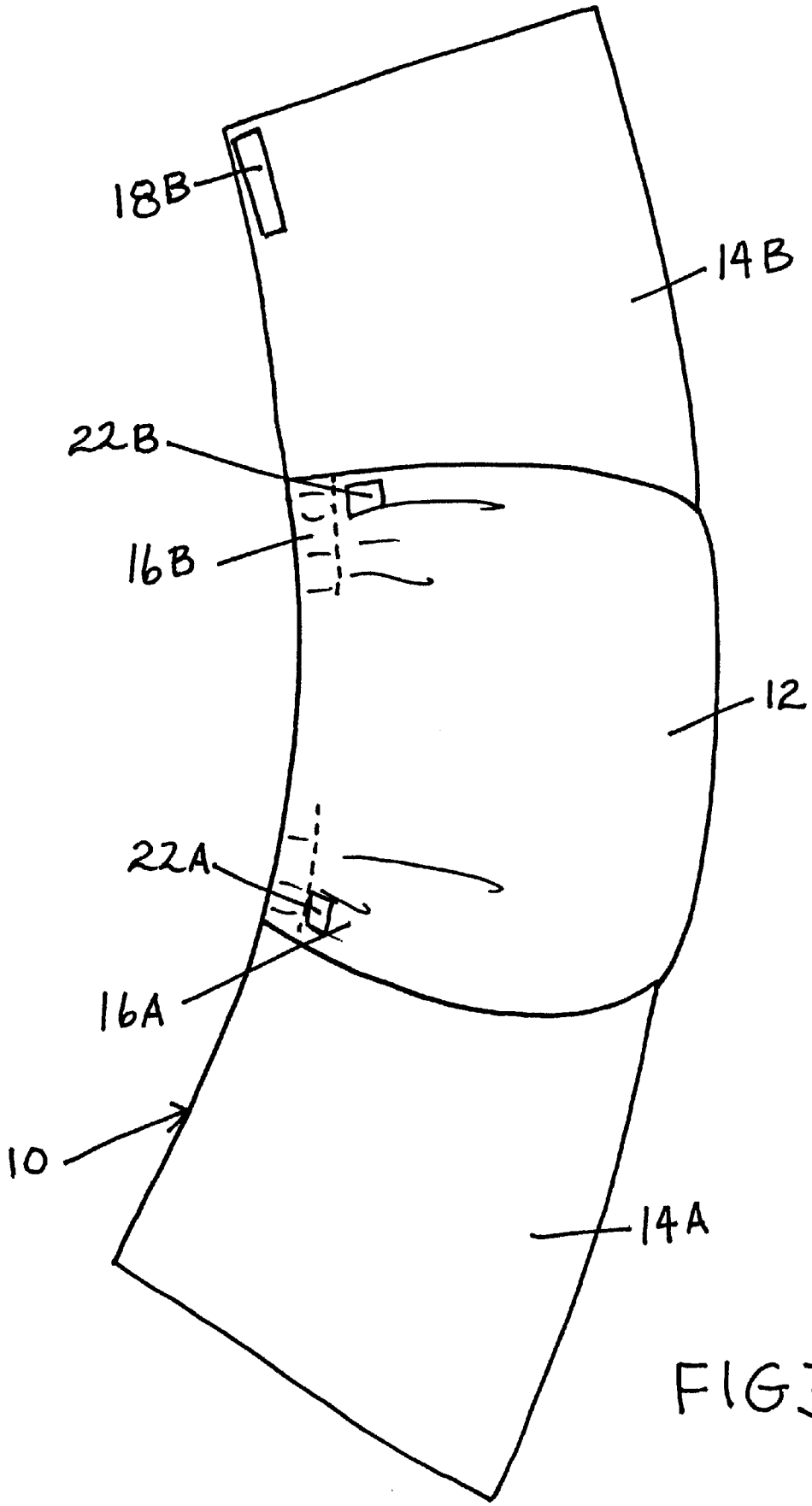
FIGS. 3A and 3B are the outside and inside view of separated lower torso garment, respectively of FIG. 2A and 2B in a flat open position.
Figure 3B:
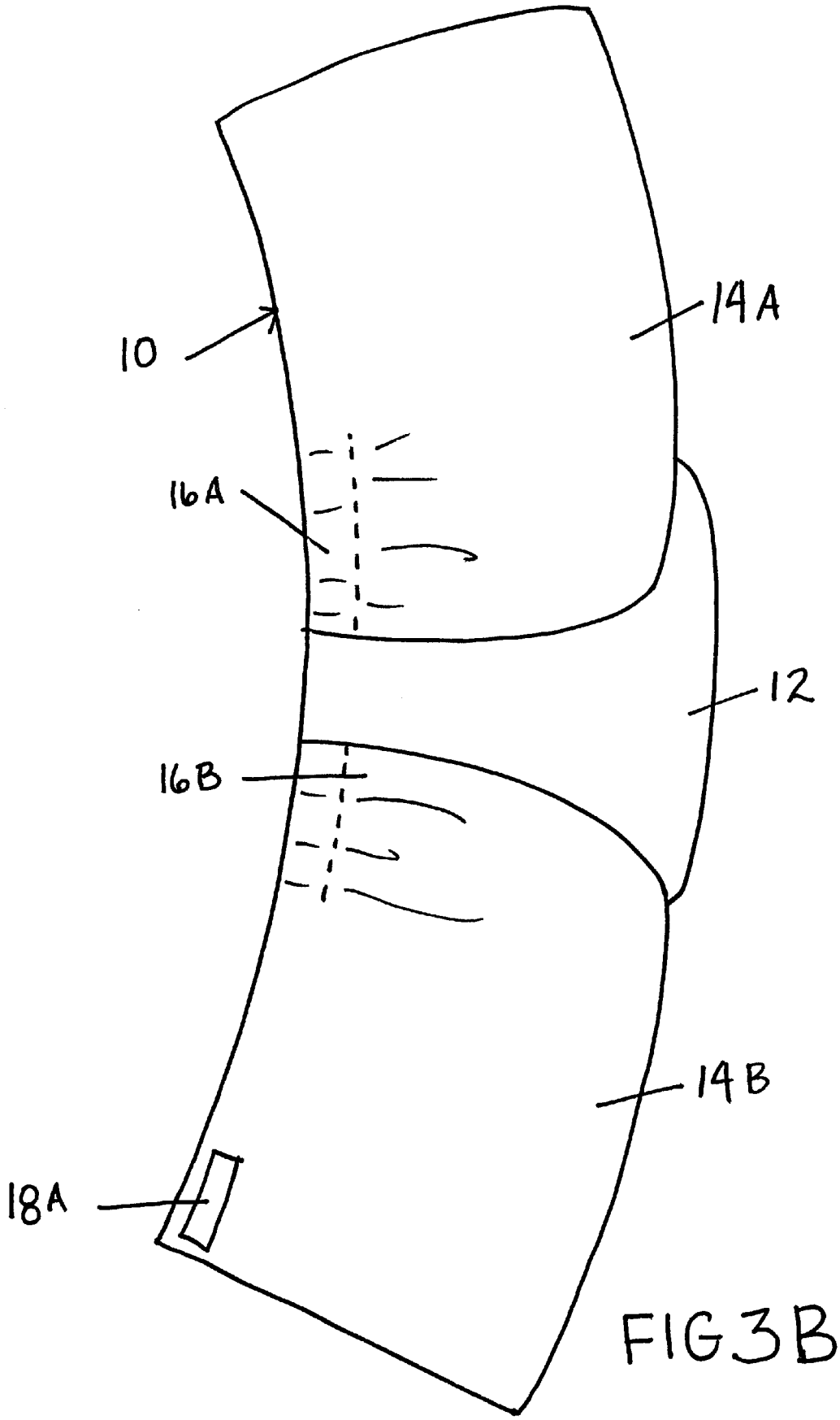

FIGS. 2A and 2B are perspective views of a male wearing the garment 10; front and rear view respectively. The garment 10 covers the lower torso of a person, which includes the buttocks, hips, upper thigh, and pelvic area. The triple paneled lower garment 10 can be seen in an open outside and inside flat view in FIG. 3A and FIG. 3B respectively. The garment 10 comprises three partially attached panels 12, 14A, and 14B, which vertically over-lap 16A and 16B to form a rectangular shape. Edges of panels 14A, 14B, and 12 are secured together along the top edge by stitching, for example. Heat sealing and other forms of securing may be used with disposable material. A center panel 12 overlaps side panels 14A and 14B as illustrated in FIG. 3A. The corners of the center flap 12 may be curved for an attractive look. Likewise the overlapping corner of the side panels 14A and 14B may be curved. The length of the garment is sufficient to cover the torso of the wearer and overlap 20 as shown in FIG. 2B. A fastening means 18A and 18B such as hook and loop fastener attaches the two ends at the waist. Elastic may be sewn or encased between the overlap 16A and 16B and/or along the waist allowing a comfortable fit for persons of varying girths.

Figure 6:
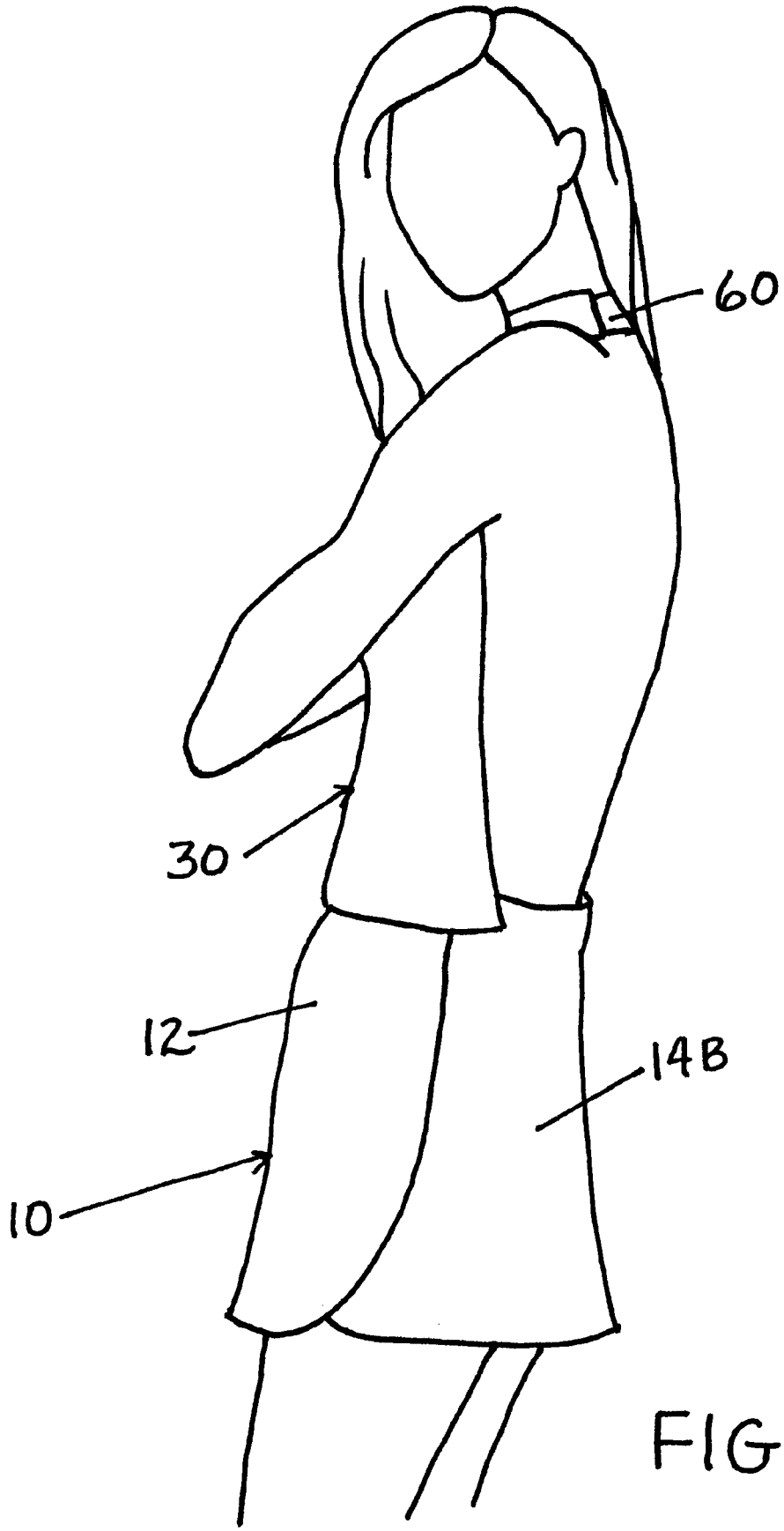
FIG. 6 is a side view of FIG. 1.

For female persons, a detachable bib 30 can be worn which covers the breast area as illustrated in FIG. 1 and FIG. 6. Shoulder extentions 38A and 38B are fastened together at the nap of the neck 60 with fastening means 34A and 34B such as hook and loop fasteners as illustrated in FIG. 6. The bib 30 attaches to the garment 10 or 40 from fasteners 32A and 32B on the inside 36 to the fasteners 22 or 42A and 22 or 42B on the outside of garment 10 or 40 overlapping as illustrated in FIG. 1. FIG. 4 shows a flat outside view of the detachable bib 30 in an unfastened position. FIG. 6 shows a perspective view of FIG. 1.

Figure 5A:
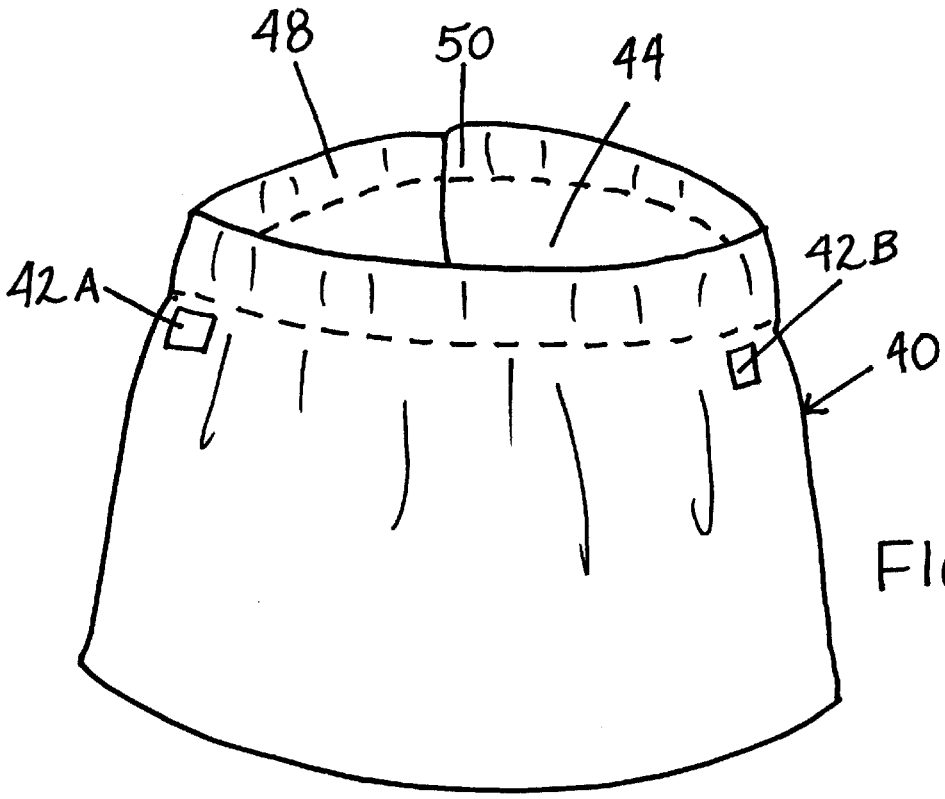
FIGS. 5A and 5B is a perspective view of the lower torso garment with a single panel in a closed position front and rear respectively.
Figure 5B:
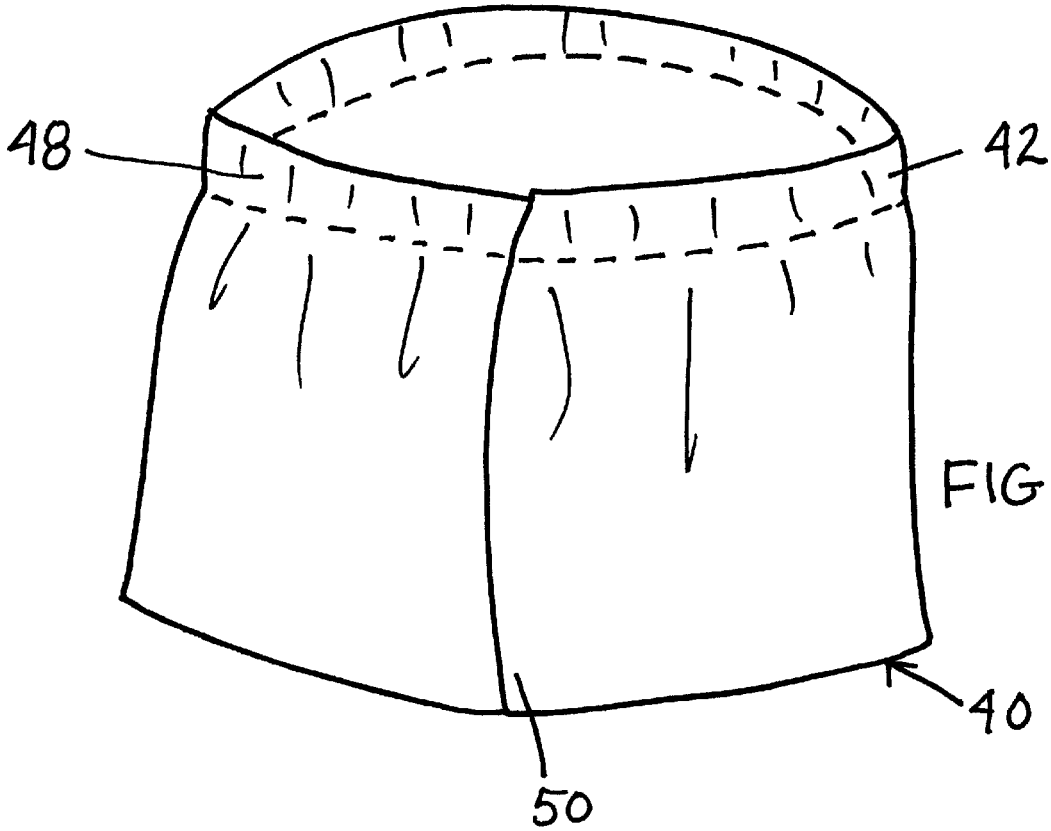
Figure 5C:
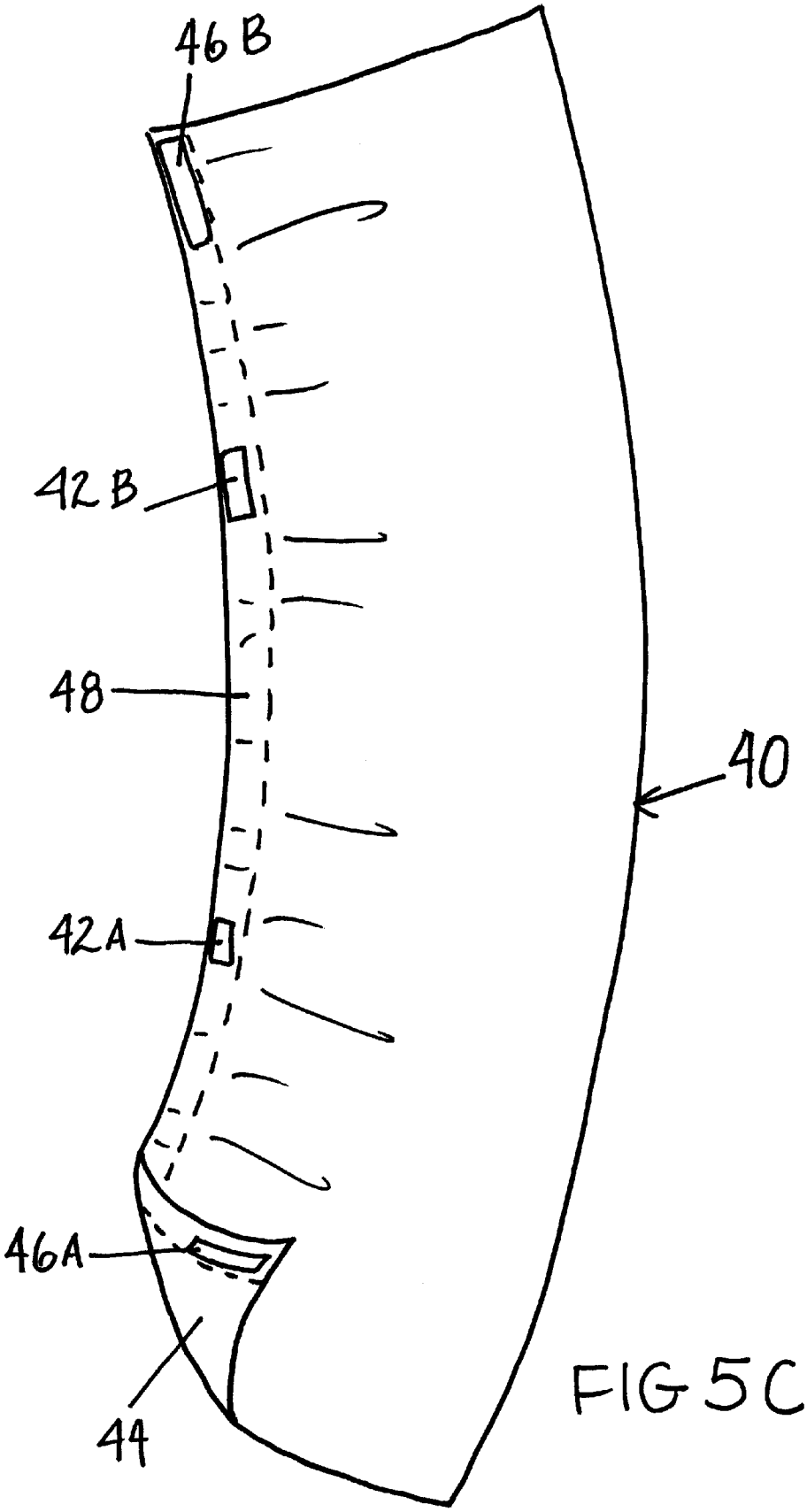
FIG. 5C is a flat open view of FIG. 5A.

FIGS. 5A, 5B, and 5C—Alternative Embodiments of Lower Torso Garment

Various alterations to the garment construction of the invention are possible while remaining within the spirit and scope of the invention. For example, the lower torso garment can be made with one single rectangular shaped panel, as illustrated in FIG. 5A, 5B, and 5C. FIG. 5A and FIG. 5B shows a perspective view of the garment 40, front and rear respectively in an attached, closed position. FIG. 5C shows an outside flat view of the garment 40 in an open position. With this alternative embodiment, adjustable means are provided preferably by elastic encased along the waistline 48 of the garment 40.

Operation FIGS. 1–5C

The garment FIG. 1 and FIG. 5A is simple to use any time, anywhere personal privacy is needed.

The garment 10 or 40 overlaps 50 or 20 and attaches in the back with fasteners such as hook and loop fasteners 18A and 18B. Women have an optional bib 30, which covers the breast area. The shoulder extensions attach 34A and 34B behind the neck 60, and can be secured to the front waist of the lower torso garment 10 or 40 by fasteners 42A and 42B such as hook and loop fasteners. For clothes changes, the lower torso garment 10 or 40 is placed over the under garments or pants of the wearer. The undergarments are removed under the garment. If pulling the undergarments up or down is difficult for the wearer due to frailty or disability, a caregiver can reach with ease the undergarments needing changed. Place a detachable bib 30 over the wearer's bra, if a female. Remove and/or replace undergarments under the garment. The private body areas of the wearer stay hidden under the garment.

The operation is the same for changing in and out of a swimming suit. The garment can be worn in the shower standing or sitting. The complete bathing process can be in privacy, including removal of undergarments, showering, bathing, and dressing into dry clothes. The unique design allows for easy access for the wearer or caregiver under the garment 10 or 40 without compromising intimate hygiene. A wearer or caregiver have points of entry for personal care; a) under the panels 12, 14A and 14B, b) between overlapping panels 16A and 16B, c) where garment overlaps 20 or 50 and for the female wearer, d) under the bib 30 when detached from the lower garment. The upper torso bib 30 covers when bent over, as it is secured at the waist with fasteners 32A and 32B, such as hook and loop.

When drying the body is desired, place a dry garment over the wet garment detach the wet garment and remove under the attached dry garment while still worn. The wearer is covered and ready to dress with privacy. Undergarments slip on with ease under the garment.

For toilet duties, simply place the garment over the wearer's undergarments for preparation for their removal. Private body areas are out of view and dignity is maintained for the wearer through the complete process.

Conclusion, Ramifications, and Scope

Accordingly, the reader will see that it has now been found that personal privacy can be readily attained with a personal care garment. When in the presence of others, personal care such as clothing changes, bathing, and toilet duties can be performed without embarrassment. Where dignity was once traditionally lost, it now can be found with this simple, attractive, easy to use garment. The additional advantages include:

- the easy-care nature of a small light weight accessory-type garment, which travels well.
- attractive fabrication choices, colorful designs, and school logos which can be printed on the front of the garment.
- scaling down the size to fit children, as they too suffer shame when viewed unclothed.
- attractive and varied changes in the style to suit the fashion-conscious consumers, without affecting the function and utility of the garment.
- can be purchased in separate pieces, as the male wearer would not need the women's detachable bib for example.
- the panels, bib, and entire garment can be altered to fit various sizes.
- the many functions of the bib. An example of this would be as a dignity drape to cover the female's breast area if exposed during emergency procedures by paramedics or other EMTs.
- allowing personal privacy to prison inmates when in community bathrooms or cells.
- providing personal privacy in hospitals when bathing is needed.
- providing emergency cover at a public beach when changing areas are not available.
- providing emergency cover in the car if clothing becomes soiled and a change would be needed.
- providing coverage and privacy during exams or procedures.

Although the description above contains many specificities, these should not be constructed as limiting the scope of the invention but merely providing illustrations of some of the presently preferred embodiments of this invention.

Thus the scope of the invention should be determined by, the appended claims and their legal equivalents, rather than by the examples given.

What is claimed is:

1. A separable personal care garment system to cover private body areas comprising:

a) a lower torso garment comprising: at least one panel of flexible fabric to form a rectangular shaped skirt having a length, and an overlapping end portion, said end portion held in place by a fastening means; whereby the pelvic and buttock area are covered;

b) a upper torso bib comprising: a panel of flexible fabric having a lower edge waist portion adapted for attaching to said lower torso garment, a shoulder extension along each side edge, said shoulder extensions being releasably attached to each other by fastening means to form a neck opening; whereby said upper torso bib is held in place and a wearer's breast area is covered; and c) a means for attaching said upper torso bib and said lower torso garment at said waist portion, said means comprising: a first fastener attached to said upper torso bib and a second fastener attached to said lower torso garment and arranged to release said upper torso bib; whereby allowing removal and access to said breast area.

2. The garment of claim 1 wherein said lower torso garment has adjustable means to accommodate girths of various dimensions.

3. The garment according to claim 1 wherein said lower torso garment has a length sufficient to encircle the torso of a person.

4. The garment according to claim 1 wherein said fabric is made of water resistant material.

5. The garment according to claim 1 wherein said fabric is made of disposable material.

6. The garment according to claim 1 wherein said fabric is made of a durable, reusable, and washable material.

7. The garment according to claim 1 wherein said fabric is made of water repellent material.

8. The garment according to claim 1 wherein said fastening means and said means for attaching are hook and loop fasteners.

9. A personal care garment for the lower torso comprising:

a) at least one panel of flexible fabric to form a rectangular shaped skirt having a length;

b) at least one component of fastening means adapted to couple with a corresponding component part; whereby allowing optional attachment of an upper garment; and c) an overlap portion, said overlap portion held in place by a fastening means; whereby the pelvic and buttock area are covered.

10. The garment of claim 9 wherein said panels of said garment are approximately equal in size, comprising: a center panel overlapping a second panel and a third panel on either side and being connected along an upper edge at the waistline.

11. The garment of claim 9 wherein said garment has adjustable means to accommodate girths of various dimensions.

12. The garment according to claim 9 wherein said length is sufficient to encircle the torso of a person.

13. The garment according to claim 9 wherein said fabric is made of water resistant material.

14. The garment according to claim 9 wherein said fabric is made of disposable material.

15. The garment according to claim 9 wherein said fabric is made of a durable, reusable, and washable material.

16. The garment of claim 9 wherein said fastening means is a hook and loop fastener.

17. A upper torso bib comprising:

a) a panel of flexible fabric having a lower edge waist portion;

b) a shoulder extension along each side edge, said shoulder extensions being releasably attached to each other by fastening means to form a neck opening; whereby said upper torso bib is held in place and breast area is covered; and c) at least one component of fastening means it said waist portion adapted to couple with a corresponding component part on another garment at said waist portion; whereby allowing optional attachment of said another garment.

18. The garment of claim 17 wherein said fabric is made of water-repellent material.

19. The garment of claim 17 wherein said fabric is reusable and washable.

20. The garment of claim 17 wherein said fabric is made of disposable material.

21. The garment of claim 17 wherein said fastening means is hook and loop fasteners.

* * * * *